US011173738B2

(12) United States Patent
He

(10) Patent No.: US 11,173,738 B2
(45) Date of Patent: Nov. 16, 2021

(54) HIGH FREQUENCY SUSPENSION THERMAL TRANSFER PRINTERS WITHOUT PRESSURE

(71) Applicant: YIWUSHI TAILE MECHANICAL EQUIPMENT CO., LTD., Zhejiang (CN)

(72) Inventor: Guangfeng He, Minle Town (CN)

(73) Assignee: Yiwushi Taile Mechanical Equipment Co., Ltd.

( * ) Notice: Subject to any disclaimer, the term of this patent is extended or adjusted under 35 U.S.C. 154(b) by 120 days.

(21) Appl. No.: 16/749,876

(22) Filed: Jan. 22, 2020

(65) Prior Publication Data

US 2021/0094334 A1 Apr. 1, 2021

(30) Foreign Application Priority Data

Sep. 26, 2019 (CN) ..... 201910914265.5

(51) Int. Cl.
*B41J 2/385* (2006.01)
*B41M 5/035* (2006.01)

(52) U.S. Cl.
CPC ..... *B41M 5/035* (2013.01); *B41J 2/385* (2013.01)

(58) Field of Classification Search
CPC ..... B41J 3/36; B41J 2/385
See application file for complete search history.

(56) References Cited

U.S. PATENT DOCUMENTS 6,338,555 B1 * 1/2002 Hirose ..... B41J 2/16508 347/109
2020/0307255 A1 * 10/2020 Takai ..... B41J 3/4075
2021/0122176 A1 * 4/2021 Breton ..... B41J 3/36

* cited by examiner

*Primary Examiner* — Scott A Richmond
(74) *Attorney, Agent, or Firm* — Robert D. Atkins; Patent Law Group: Atkins and Associates, P.C.

(57) ABSTRACT

A pressureless high-frequency suspension thermal transfer printer is disclosed, in which a high-frequency signal of 60-100 Hz is generated by a high-frequency switching power supply, and a high-frequency energy conversion motor is driven to convert a signal into high-frequency mechanical vibration which produces 60-100 Hz high-frequency waves which propagate in a longitudinally diffused manner in which an entire transfer printing surface is covered in a direction that is perpendicular to the transfer printing surface, avoiding wasteful loss in the direction of lateral propagation parallel to the transfer printing surface, so that the high-frequency waves act on a molecular movement during the transfer printing process to the greatest extent, which effectively changes a state of the molecular movement, enhances a molecular penetration force, realizes replacement of physical pressure with the high-frequency waves, completely changes a thermal transfer printing process, and achieves pressureless thermal transfer printing.

8 Claims, 11 Drawing Sheets

HIGH FREQUENCY SUSPENSION THERMAL TRANSFER PRINTERS WITHOUT PRESSURE

TECHNICAL FIELD

The present disclosure relates to the technical field of thermal transfer printing, in particular to a pressureless high-frequency suspension thermal transfer printer.

BACKGROUND

The thermal transfer printing process is mainly divided into two categories: sublimation thermal transfer printing and film thermal transfer printing:

Sublimation thermal transfer printing: low-energy, easy-to-sublimated disperse dyes is made into digital printing inks and printed on transfer printing paper. By heating and pressurizing, the ink sublimates directly from solid particles to gas molecules and infiltrates the transfer product surface. Patterns can be made into exquisite porcelain, metal, silk, fiber fabric, cloth and other materials in 1-3 minutes.

Specifically, a digital transfer printer prints a pattern (imaging ink layer) on a printing paper (printing a pattern carrier layer) to form a "thermal transfer printing sublimation paper". The "thermal transfer printing sublimation paper" is covered on a "thermal sublimation product" to form a fine space "a" between them. The value of "a" in the traditional "sublimation thermal transfer printing" is (0 mm≤a≤0.2 mm). In this process, the role of "physical pressure" is that the pressure directly acts on the "thermal transfer printing sublimation paper" and causes it to fit with the product surface (a≈0 mm). This is because the vaporization molecules of the sublimation ink have poor propagation properties in the air, and the smaller the value of "a", the higher the transfer printing rate. Therefore, if there is insufficient pressure (a≥0.2 mm), the sublimation transfer printing rate will be lower than 65%, causing the pattern to become white or defective. (The transfer printing rate refers to the ratio of the ink in "imaging ink layer" that sublimates and transfers to the surface of the "sublimation product". It is measured from 1-100, and 65% or more is qualified and 90% or more is preferred.)

Film thermal transfer printing: in which patterns and texts are made into a thermal transfer printing film (that is, film) with an adhesive. By heating and pressurizing, the adhesive layer is melted and penetrates into the inside of the fabric fiber, and the pattern can be made on the fiber fabric, cloth and other materials within 3-30 seconds. The film is generally composed of 3 to 5 layers. The three-layered thermal transfer printing film is composed of a base layer, a printing layer and an adhesive layer; the four-layered thermal transfer printing film is composed of a base layer, a release layer, a printing layer and an adhesive layer; the five-layered thermal transfer printing film is composed of a base layer, a release layer, a printing layer, an adhesive layer and a hot-melt adhesive powder layer.

Specifically, the batch printing machine prints the patterns (printing imaging ink layer) on the film (printing pattern carrier layer), and the coating machine applies hot melt adhesive to the pattern ink (adhesive glue layer) to form a "thermal transfer printing film" (i.e., commonly known as: the base layer, the printing layer and the adhesive layer). The "thermal transfer printing film" is covered on the "fabric product" to form a micro space "b" between each other. The value of "b" in the traditional "film thermal transfer printing" is (0 mm≤b≤0.05 mm). In this process, the role of "physical pressure" is that the pressure directly acts on the "thermal transfer printing film" and causes it to fit with the surface of the product (b≈0 mm). By "physical pressure", the melted glue is pressed into the fabric fibers, so that the glue fully covers the fibers and thus the pattern adheres to the surface of the fabric and does not fall off. The greater the physical pressure, the stronger the pattern adhesion. Therefore, if there is insufficient pressure (b≥0.05 mm), the adhesion will be lower than 50%, which will cause insufficient gluing or peeling off of the pattern. (Adhesion refers to the firmness of the "adhesive glue layer" glued to the surface of the "fabric product", measured by the degree of surface damage of the "printing ink layer" and the "fabric product" after tearing. It is measured from 1-100. A degree of 50% or higher is qualified and 75% or higher is preferred).

There are many different types of thermal transfer printers on the market, which are designed and manufactured taking into consideration of the three necessary conditions of time, temperature and pressure.

The heating method and time control are basically the same. After being heated by electric wire, the heat is transferred to the pattern carrier through the contact of the flat plate.

The principles of pressurization are the same, mainly by the principle of lever and pneumatic cylinder. For the same physical force, the larger the pressed area is, the smaller the pressure is. In order to keep the pressure constant when the area increases, it is necessary to increase the physical force. In other words, the larger the transfer area is, the greater physical force is needed, and the more solid the main frame of the equipment and the heavier the equipment is required.

With the increasing awareness of personalization, the demand for portable and compact devices is growing. The original large-scale equipment and bulky small equipment could not meet the flexibility requirement of the market at all, so everyone in the industry is constantly modifying the equipment structure in order to reduce the volume and weight of the equipment. There are also some small portable devices on the market, which exert physical force on the device directly by both hands. The force that the human body exerts on the device is very unstable. Beside strength, endurance varies among individuals. The transfer printing process requires time, and the time varies among different products. Some require more than ten seconds, and some require two or three minutes. That is to say, in these ten seconds or two or three minutes, both hands must insist on exerting force on the device without releasing, which relies entirely on human endurance. Under this unstable force, it is difficult to assure the quality of the transfer printed product, and it is impossible to complete a product whose transfer time is longer than 60 seconds.

In addition, the difficulty of operation will increase in handling with wrinkled fabric products (such as cloth). It is necessary to manually level the transfer printing processing surface before it can be transfer printed. It is very time-consuming and requires certain experience for the operator. It is easy to cause crease or distortion if it is not handled properly, which leads to the waste of consumables or the disqualification of products.

Because hand pressing is limited by the endurance of the human body, the pattern carrier is also limited to products with a short transfer printing time, such as film which requires a transfer printing time of 10-15 seconds. The production of film involves plate printing. The pattern needs to be customized in large quantities to reduce the cost. For small-scale production, the pattern cannot be customized and the individual needs cannot be met. The processes in which pattern can be customized in small quantities all require the use of a printer. The transfer printing time of such processes is longer (above 60 seconds). It is hard to persist by hand pressing. Therefore, these portable small devices on the market have great limitations in personalized transfer printing.

SUMMARY

(1) Technical Problems Solved

The object of the present disclosure is to overcome the shortcomings of the prior art, and to provide a pressureless high-frequency suspension thermal transfer printer, in which a high-frequency signal of 60-100 Hz is generated by a high-frequency switching power supply, and a high-frequency energy conversion motor is driven to convert the signal into high-frequency mechanical vibration which produces 60-100 Hz high-frequency waves which propagate in a longitudinally diffused manner in which an entire transfer printing surface is covered in a direction that is perpendicular to the transfer printing surface, see FIGS. 1 and 2, avoiding wasteful loss in the direction of lateral propagation that is parallel to the transfer printing surface, so that the high-frequency waves act on a molecular movement during the transfer printing process to the greatest extent, which effectively changes a state of the molecular movement, enhances a molecular penetration force, realizes replacement of physical pressure with the high-frequency waves, completely changes a thermal transfer printing process, and achieves pressureless thermal transfer printing.

(2) Technical Solutions

A pressureless high-frequency suspension thermal transfer printer, comprising a host assembly, wherein the host assembly is provided from top to bottom with an outer shell, an inner shell, a secondary thermal insulation shell, a fixing shell, a primary thermal insulation shell and a heating plate; a handle tray is provided between the outer shell and the inner shell, a high-frequency energy conversion motor is provided between the handle tray and the inner shell; a handle beam is provided on a top of the handle tray, a radiator is provided in the handle beam, and a control output board is installed in the radiator; the heating plate is also provided with a snap-action temperature controller and a temperature sensor; a central control board is provided on a rear top of the outer shell, a high-frequency switching power supply is provided below the central control board, and the high-frequency switching power supply is connected to an external power line which is provided with a plug at an outer end; and a control panel is provided on a rear top surface of the outer shell.

Further, the high-frequency switching power supply is electrically connected to the control output board through a high-frequency current input line, the control output board is electrically connected to the central control board through a signal transmission line, the control output board is electrically connected to the high-frequency energy conversion motor through a high-frequency current output line, the temperature sensor is electrically connected to the central control board through a temperature signal transmission line, and the power line receives a 220V AC power and is divided into two circuits, one of which is directly connected to the high-frequency switching power supply and converts the 220V AC power into 60-100 Hz oscillating current that flows into the control output board, and the other of which is connected to the control output board, to the snap-action temperature controller and then to the heating plate.

Further, the central control board controls connection and disconnection to the 220V AC power, the temperature sensor is connected to the central control board to collect temperature data of the heating plate to provide basic data for temperature control, the control output board is connected to the central control board and receives various instructions from the central control board to control start and stop of the high-frequency energy conversion motor and start and stop of the heating plate, the snap-action temperature controller causes a power to cut off when the heating plate reaches a temperature limit, and buttons on the central control board correspond to buttons on the control panel.

Further, the primary thermal insulation shell is an asbestos high-temperature resistant thermal insulation layer and prevents heat from transferring from the heating plate to the fixing shell, the secondary thermal insulation shell is also an asbestos high-temperature resistant thermal insulation layer and prevents heat from transferring from the fixing shell to the outer shell; the fixing shell is made of PA66+15% GF by injection molding.

Further, the heating plate is a flat structure of die-casting aluminum with intermediately buried heating tubes, the heating tubes being distributed in a serpentine shape and a plurality of which are connected in series.

Further, a bottom edge of the outer shell and a edge of the fixing casing are correspondingly provided with a first type of fixing holes and are connected by the inner cross countersunk head self-tapping screw; a hole plug made of high temperature resistant silicone is provided outside the inner cross countersunk head self-tapping screw;

A top edge of the inner shell is fixed with a top plate by an inner cross round head cut tail self-tapping screw;

A bottom of the handle tray is provided with a first type of connecting column and is connected with a top plate of the inner shell by the inner cross round head cut tail self-tapping screw; a handle beam is provided at the top of the handle tray, the radiator is arranged in the handle beam, and two sides of the radiator are connected with an edge of the inner shell by an inner cross round head screw;

The heating plate is provided with a second type of connecting column, the primary thermal insulation shell is correspondingly provided with a perforation, the fixing shell is correspondingly provided with a second type of fixing holes, and the second type of fixing holes are internally screwed with the inner cross round head screw, a first thermal insulation gasket and a second thermal insulation gasket are provided between the top of the inner cross round head screw and the fixing shell, a bottom end of the inner cross round head screw passes through the perforation and is screwed to the second type connecting column, a third thermal insulation gasket is provided between the lower section of the inner cross round head screw and the fixing shell; and an inner diameter of the perforation of the primary thermal insulation shell is larger than a diameter of the inner cross round head screw;

The fixing shell is provided with a cross engaging column, and the secondary thermal insulation plate is correspondingly provided with a cross hole which matches with the cross engaging column.

Further, the high-frequency energy conversion motor is stuck between the handle tray and the inner shell, an inner cross countersunk head cutting tail self-tapping screw is provided on both sides, and the inner cross countersunk head cutting tail self-tapping screw is screwed on a bottom of the handle tray and fixes the high-frequency transducer motor at a limited position;

The central control board is fixed on an inner side of the outer shell by an inner cross round head padded self-tapping screw; the high-frequency switching power supply is fixed on the inner shell by the inner cross round head padded self-tapping screw; the inner shell and the outer shell are correspondingly provided with wire outlets at rear ends; an inner side of the inner shell that corresponds to the wire outlet is provided with a wire clamp, and the power line extends out from the wire outlet after being clamped by the wire clamp and is provided with a wire protection tube;

The snap-action temperature controller (401) and the temperature sensor are fixed on the heating plate by the inner cross round head screw.

Further, the pressureless high-frequency suspension thermal transfer printer further comprises a placing plate within which the host assembly is cooperatively arranged;

The placing plate has a ring shape, which is composed of identical four-segment quarter-arc-shaped pieces which are clipped with each other by head and tail; feet are provided at bottom part of the placing plate; the placing plate is provided with a limiting block on outer ring and a suspension on inner ring.

A method for controlling a pressureless high-frequency suspension thermal transfer printer, comprising: connecting a power line to an external power source by a central control board, collecting temperature data of a heating plate, calculating and generating a control signal, and sending the control signal to a control output board and controlling the control output board to turn on a circuit of the heating plate; the control output board controls the heating plate to start heating according to a heating temperature set by the central control board, and a constant temperature is maintained after the heating plate reaches a set temperature; the high-frequency energy conversion motor starts and stops according to a transfer printing time set by the central control board;

Different transfer printing times are set according to a time required by a product; the high-frequency energy conversion motor starts synchronously and counts down; when the countdown ends, the transfer printing is completed and the high-frequency energy conversion motor stops working at the same time.

A pressureless high-frequency suspension thermal transfer printing method, wherein a high-frequency signal of 60-100 Hz is generated by a high-frequency switching power supply, and a high-frequency energy conversion motor is driven to convert a signal into high-frequency mechanical vibration which produces 60-100 Hz high-frequency waves which propagate in a longitudinally diffused manner in which an entire transfer printing surface is covered in a direction that is perpendicular to the transfer printing surface, avoiding a wasteful loss in the direction of lateral propagation that is parallel to the transfer printing surface, so that the high-frequency waves act on a molecular movement during the transfer printing process to the greatest extent, which effectively changes a state of the molecular movement, enhances a molecular penetration force, realizes replacement of physical pressure with the high-frequency waves, completely changes a thermal transfer printing process, and achieves pressureless thermal transfer printing.

(3) Beneficial Effects

The present disclosure provides a pressureless high-frequency suspension thermal transfer printer, which has the following advantages:

1. The "high-frequency waves" used in the present disclosure can completely replace the role of "physical pressure" in "sublimation thermal transfer printing". It can change the movement of "ink sublimation molecules" and drive the molecules to propagate in the air even the sublimation transfer printing rate achieves more than 90% in the case of 0.2 mm≤a≤2.1 mm.

2. The "high-frequency wave" used in the present disclosure can completely replace the role of "physical pressure" in "film thermal transfer printing". It can change the movement of "glue molecules" and drive molecules so that the adhesive force achieves more than 75% without "physical pressure" (0.05 mm≤b≤1.1 mm). 3. The present disclosure can overcome the problems of wrinkling of fabrics during thermal transfer printing in the prior art which affects the transfer effect. Longitudinal "high-frequency waves" are used combined with "heat radiation", and during the transfer printing process, a reverse thrust will be generated which lifts the equipment up and forms a micro-suspension. In this state, the woven fabric is not under pressure, and there is space for the fiber to stretch after the fiber is heated. Wrinkles formed by improper storage and transportation will not be shaped by physical pressure, and the effect of automatic leveling is achieved. The water vapor generated during the transfer printing process can be fully emitted in a micro-suspended state to ensure that no wrinkles will occur during the transfer.

4. The present disclosure can also avoid the situation where the pressure on different parts of the pattern is different in the traditional thermal transfer printing and the values of "a" or "b" differ greatly. Using "high-frequency wave" longitudinal penetrating coverage, the molecular driving force can be the same for any part of the pattern. The "high-frequency waves" have a vertical penetration depth of up to 20 cm, and can drive molecular to penetrate into uneven product surfaces.

In summary, compared with the portable devices on the market, the present disclosure reduces the overall operation difficulty and improves the transfer printing success rate. The operator can transfer qualified products without technical experience. The printer of present disclosure does not require manual compression, so that one person can operate multiple devices.

BRIEF DESCRIPTION OF THE DRAWINGS

In order to explain the technical solution of the embodiments of the present disclosure more clearly, the drawings used in the description of the embodiments are briefly introduced below. Obviously, the drawings in the following description illustrate only some embodiments of the present disclosure. For those of ordinary skill in the art, other drawings can be obtained based on these drawings without any inventive work.

Figure 1:
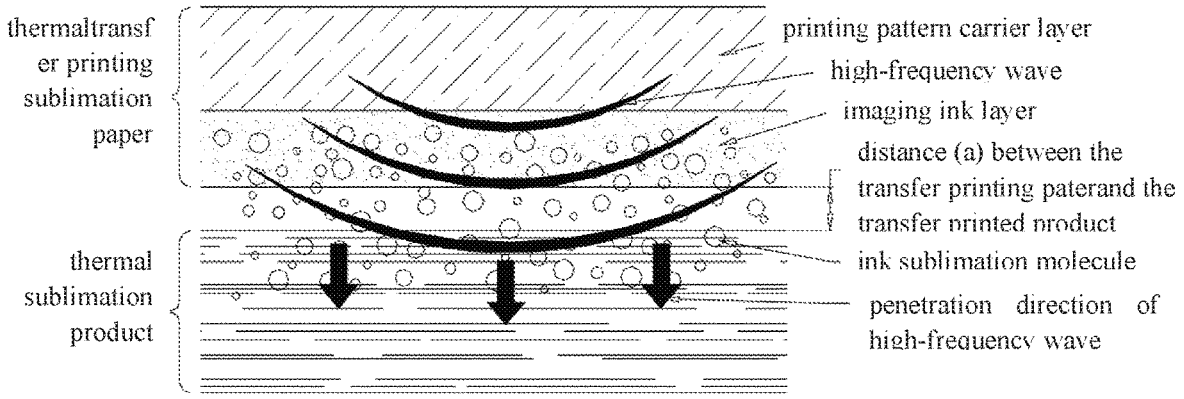
FIG. 1 is an enlarged microscopic schematic view of a thermal sublimation process.
Figure 2:
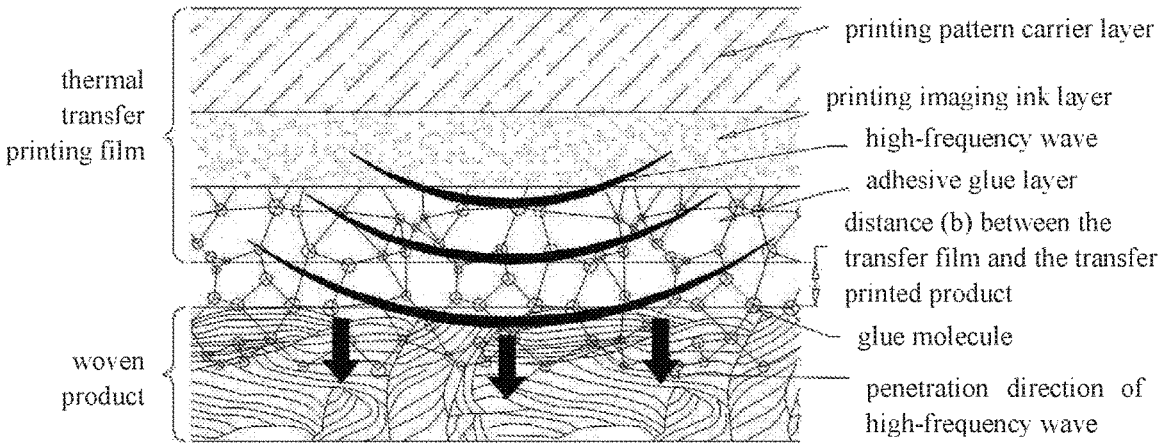
FIG. 2 is an enlarged microscopic schematic view of a film transfer printing process.
Figure 3:
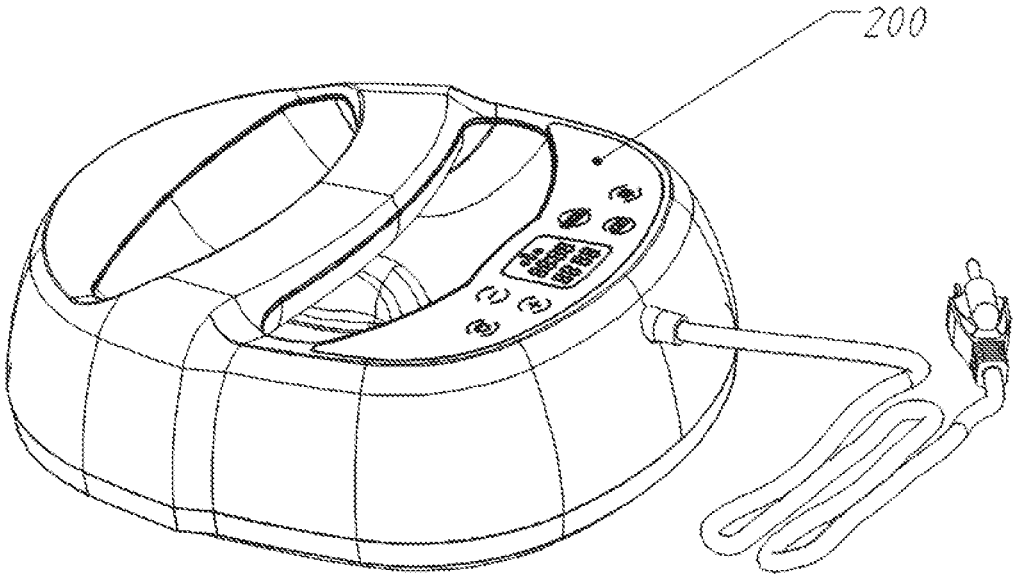
FIG. 3 is a structural view of the host assembly.

In the drawings, the list of parts represented by each reference is as follows:

100—placing plate, 101—block, 102—feet, 103—limit block, 104—suspension;

200—host assembly, 201—outer shell, 202—inner shell, 203—secondary thermal insulation shell, 204—fixing shell, 205—primary thermal insulation shell, 206—heating plate, 207—heating tube;

301—inner cross round head screw, 302—first insulation gasket, 303—second insulation gasket, 304—third insulation gasket, 305—inner cross countersunk head self-tapping screw, 306—hole plug, 307—inner cross round head padded self-tapping screw, 308—inner cross round head cut tail self-tapping screw, 309—inner cross countersunk head cut tail self-tapping screw;

401—snap action temperature controller, 402—temperature sensor, 403—control output board, 404—central control board, 405—high-frequency switching power supply, 406—high-frequency energy conversion motor;

2021—handle tray, 2022—handle beam, 2023—radiator, 2024—control panel;

501—clamp, 502—wire protection tube, 503—power line.

DETAILED DESCRIPTION OF EMBODIMENTS

The technical solution of the present disclosure will be clearly and completely described below with reference to the accompanying drawings. Obviously, the described embodiments are part of the present disclosure, but not all of them. Based on the embodiments of the present disclosure, all other embodiments obtained by a person of ordinary skill in the art without creative efforts shall fall within the protection scope of the present disclosure.

In the description of the present disclosure, it should be noted that if the terms "center", "up", "down", "left", "right", "vertical", "horizontal", "inside", "outside" and the like appear, the indicated orientation or positional relationship is based on the orientation or positional relationship shown in the drawings. They are used only for the convenience of describing the present disclosure and simplifying the description, rather than indicating or suggesting that the device or element referred to must have a specific orientation or be constructed and operated in a specific orientation, so it cannot be understood as a limitation to the present disclosure. In addition, if the terms "first", "second", and "third" appear, they are used for descriptive purposes only and cannot be interpreted as indicating or implying relative importance.

In the description of the present disclosure, it should be noted that, unless specifically stated otherwise, the terms "installation", "connected", and "linked" should be understood in a broad sense. For example, it may be a fixed connection, a detachable connection or an integral connection; it may be a mechanical connection or an electrical connection; it may be direct connection, or it can be indirect connection through an intermediate medium, or it may be the internal communication of two components. For those of ordinary skill in the art, the specific meanings of the above terms in the present disclosure can be understood according to specific situations.

Embodiment 1

Referring to FIGS. 3-8, a pressureless high-frequency suspension thermal transfer printer comprises a host assembly 200, and the host assembly 200 is provided from top to bottom with an outer shell 201, an inner shell 202, a secondary thermal insulation shell 203, a fixing shell 204, a primary thermal insulation shell 205 and a heating plate 206; a handle tray 2021 is provided between the outer shell 201 and the inner shell 202, a high-frequency energy conversion motor 406 is provided between the handle tray 2021 and the inner shell 202; a handle beam 2022 is provided on a top of the handle tray 2021, a radiator 2023 is provided in the handle beam 2022, and a control output board 403 is installed in the radiator 2023; the heating plate 206 is also provided with a snap-action temperature controller 401 and a temperature sensor 402; a central control board 404 is provided on a rear top of the outer shell 201, a high-frequency switching power supply 405 is provided below the central control board 404, and the high-frequency switching power supply 405 is connected to an external power line 503 which is provided with a plug at an outer end; a control panel 2024 is provided on a rear top surface of the outer shell 201.

Figure 8:
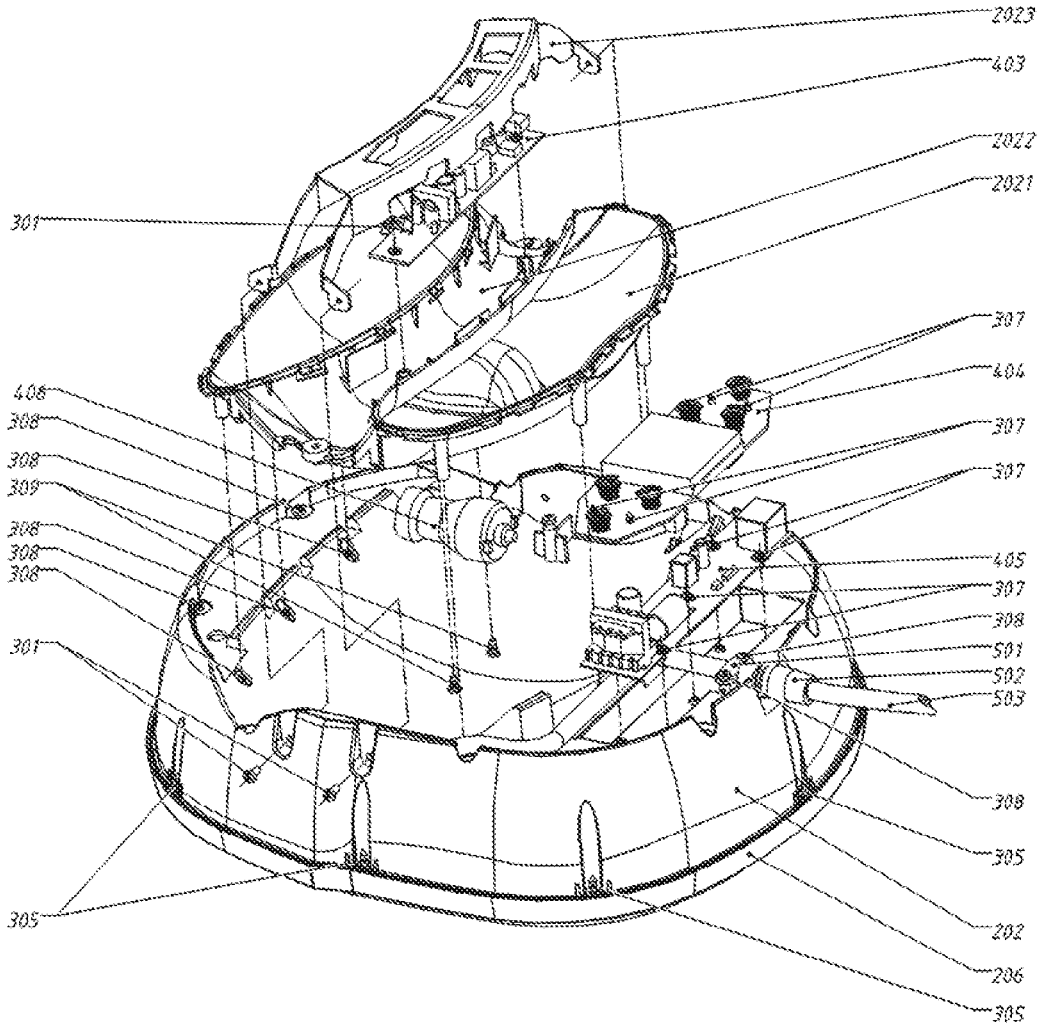
FIG. 8 is an exploded view of the host assembly after removing the outer shell.
Figure 9:
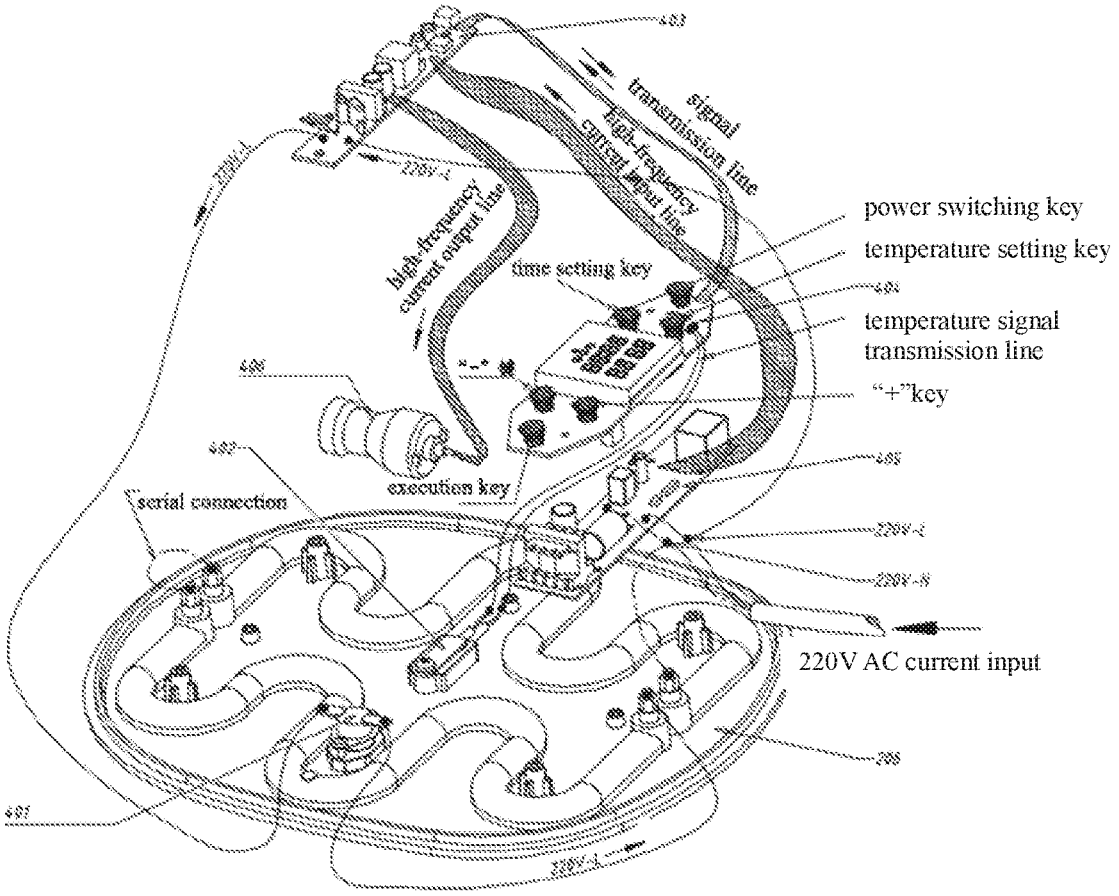
FIG. 9 is a schematic view showing the connection of various electrical components in the host assembly.
Figure 10:
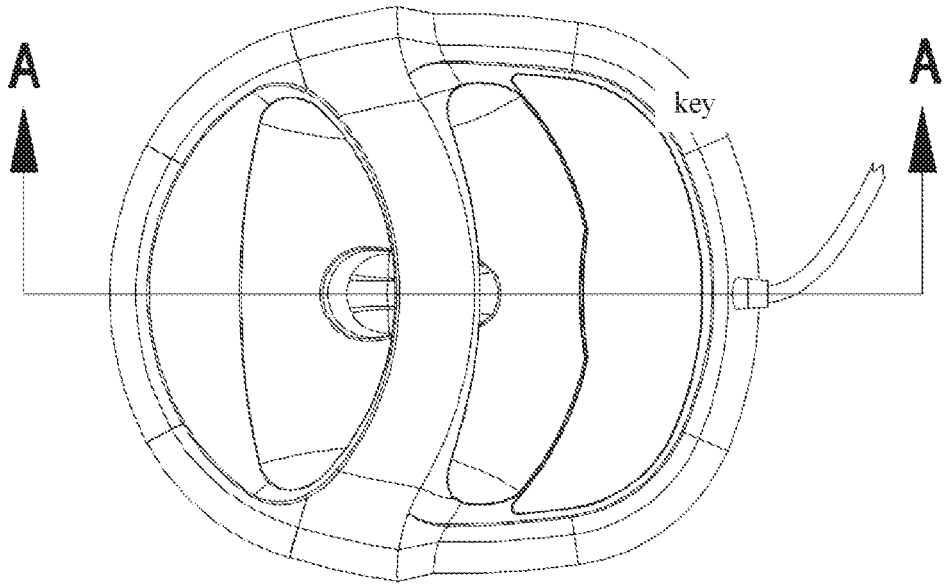
FIG. 10 is a top view of the host assembly.
Figure 11:
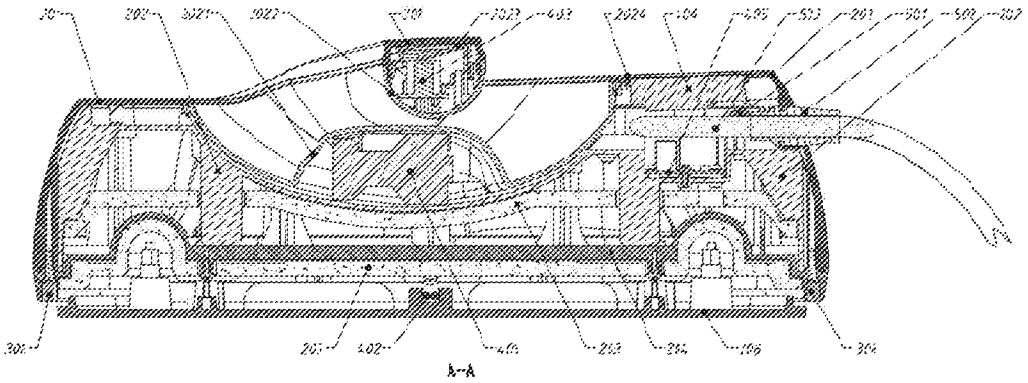
FIG. 11 is a sectional view taken along the A-A direction in FIG. 10.
Figure 12:
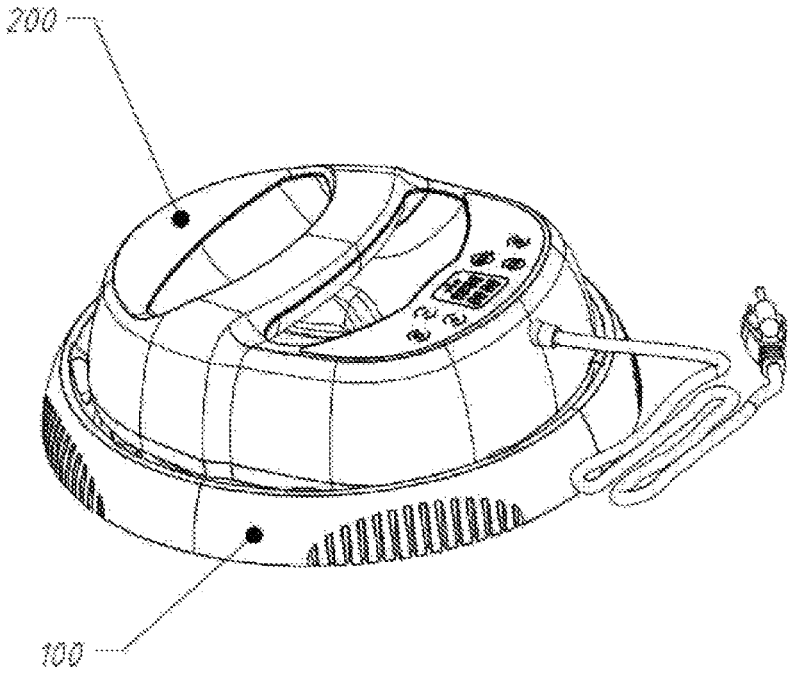
FIG. 12 is a combined structure view of the present disclosure.
Figure 13:
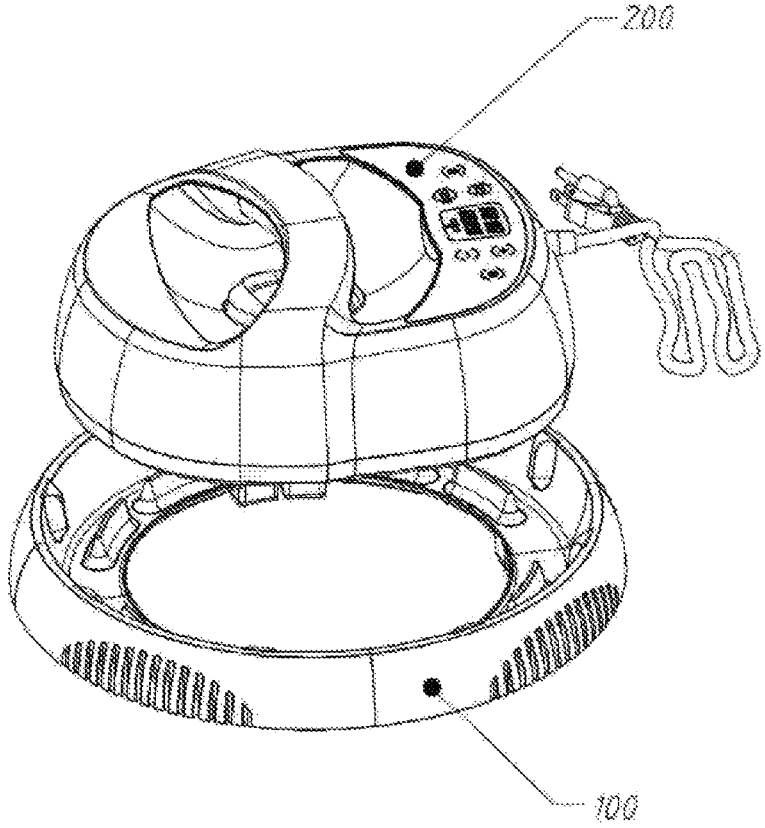
FIG. 13 is a split structure view of the present disclosure.
Figure 14:
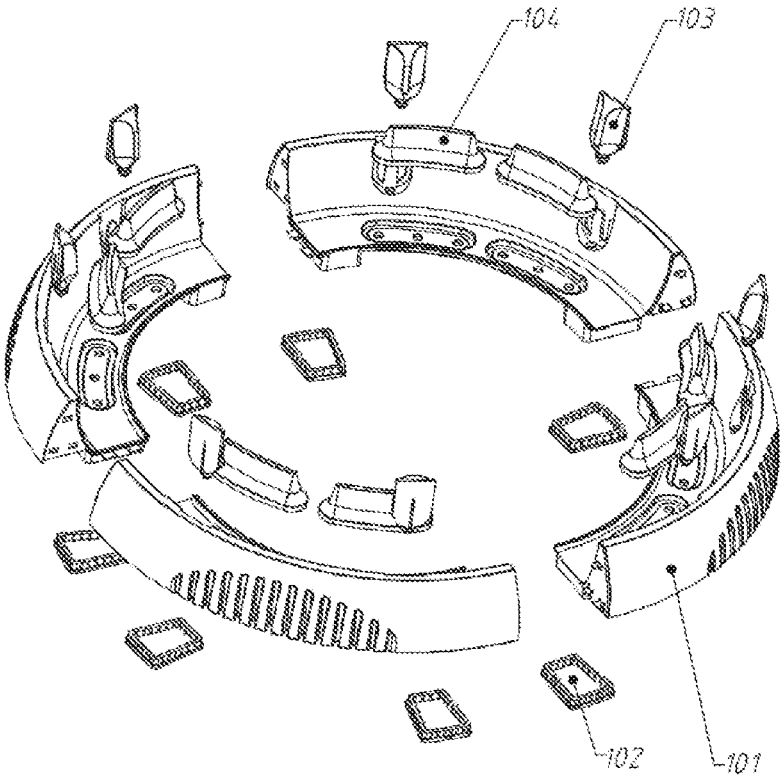
FIG. 14 is an exploded view of the placing plate.
Figure 15:
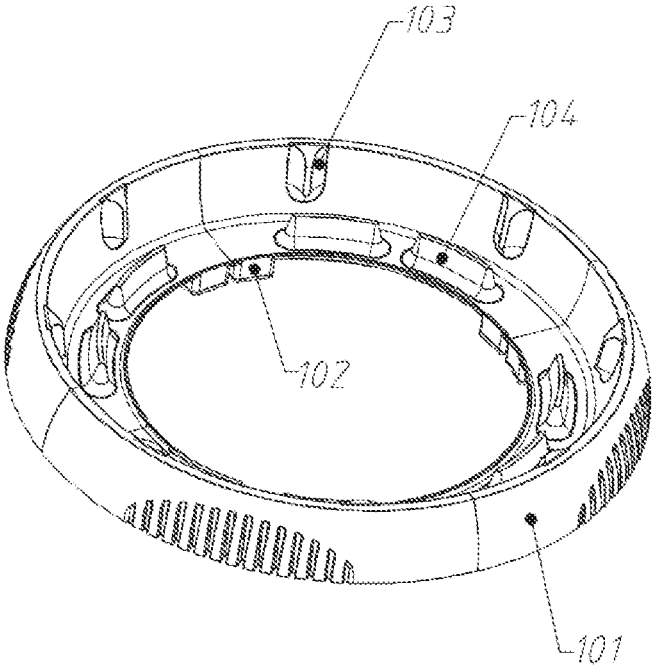
FIG. 15 is a structural view of the placing plate.
Figure 16:
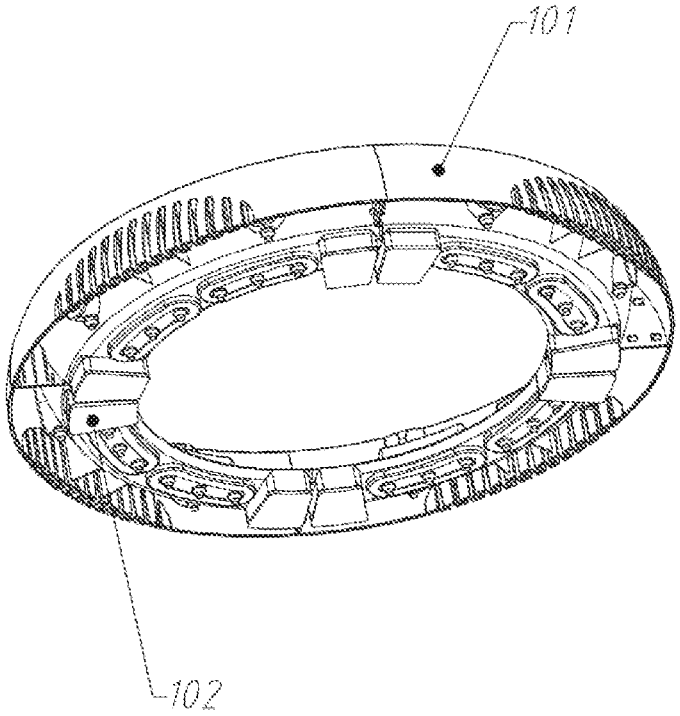
FIG. 16 is a structural view of the placing plate from another perspective.

Referring to FIG. 8, the high-frequency switching power supply 405 is electrically connected to the control output board 403 through a high-frequency current input line, the control output board 403 is electrically connected to the central control board 404 through a signal transmission line, the control output board 403 is electrically connected to the high-frequency energy conversion motor 406 through a high-frequency current output line, the temperature sensor 402 is electrically connected to the central control board 404 through a temperature signal transmission line, and the power line 503 receives a 220V AC power and is divided into two circuits, one of which is directly connected to the high-frequency switching power supply 405 and converts the 220V AC power into 60-100 Hz oscillating current that flows into the control output board 403, and the other of which is connected to the control output board 403, to the snap-action temperature controller 401 and then to the heating plate 206.

The central control board 404 controls connection and disconnection to the 220V AC power, the control output board 403 is connected to the central control board 404 and receives various instructions from the central control board 404 to control start and stop of the high-frequency energy conversion motor 406 and start and stop of the heating plate 206, and buttons on the central control board 404 correspond to buttons on the control panel 2024. The temperature sensor 402 is used to monitor and to give feedback of the heating temperature of the heating plate 206, which is convenient for the central control board 404 to achieve constant temperature control; the snap-action temperature controller 401 is provided with a limit temperature snap-action power-off physical device. When the temperature of the heating plate 206 exceeds the limit temperature, the power is cut off to ensure safe operation.

Specifically, referring to FIG. 8, the central control board 404 is provided with a power switching key (for controlling power connection of the host assembly), a temperature setting key (for presetting of heating temperature), and a time setting key (for presetting of transfer printing time), a time temperature digital display (for real-time display of transfer printing time and heating temperature), "+" key (for up regulation of preset value), "−" key (for down regulation of preset value), and an execution key (for starting of heating or transfer printing process). The control panel 2024 is provided with buttons correspondingly, and the corresponding keys are operated by pressing the buttons.

The following describes the specific control operation mode of this device:

A power line 503 is connected to an external power source by a central control board 404, temperature data of a heating plate 206 is collected, a control signal is calculated and generated, and the control signal is sent to a control output board 403 and the control output board 403 is connected to a circuit of the heating plate 206; the control output board 403 controls the heating plate 206 to start heating according to a heating temperature set by the central control board 404, and a constant temperature is maintained after the heating plate 206 reaches a set temperature; the high-frequency energy conversion motor 406 starts and stops according to a transfer printing time set by the central control board 404.

Different transfer printing times are set according to a time required by a product; the high-frequency energy conversion motor 406 starts synchronously and counts down; when the countdown ends, the transfer printing is completed and the high-frequency energy conversion motor 406 stops working at the same time.

Usage of this device is similar to that of other hand-held transfer printing devices. This device is placed on the product to be thermally transfer printed without pressing, and the foolproof operation can be completed.

1. The plug is connected to an external socket and the power switch button on the control panel 2024 is pressed to connect the power source;

2. The heating temperature preset parameters is adjusted through the temperature setting button, "+" key and "−" key;

3. The execute key is pressed to start the heating plate 206 for heating. After the temperature of the heating plate 206 reaches the set temperature, a constant temperature is maintained;

4. The transfer printing time preset parameters are adjusted through time setting button, "+" key and "−" key;

5. The execution key is pressed to start the high-frequency energy conversion motor 406 to generate a high-frequency wave to perform thermal printing on the thermal transfer printing product, and the process automatically stops after the transfer printing time is over.

6. The power is disconnected and the thermal transfer printed product is removed.

When designing this device, it is necessary to take it into account that preventing the heat of the heating plate 206 from transferring to the outer shell 201, so as to prevent the outer shell 201 from overheating and affecting the use experience.

Figure 4:
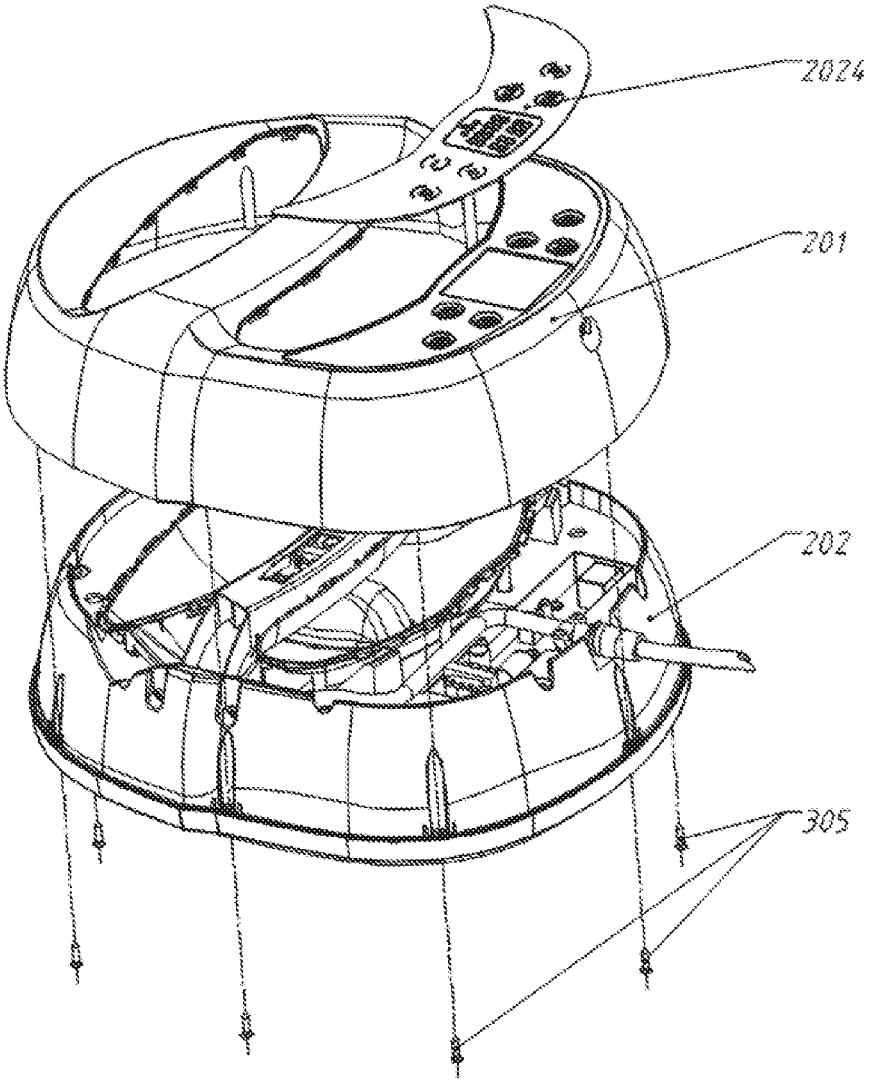
FIG. 4 is an exploded view showing the cooperation of the outer shell and the inner shell.
Figure 5:
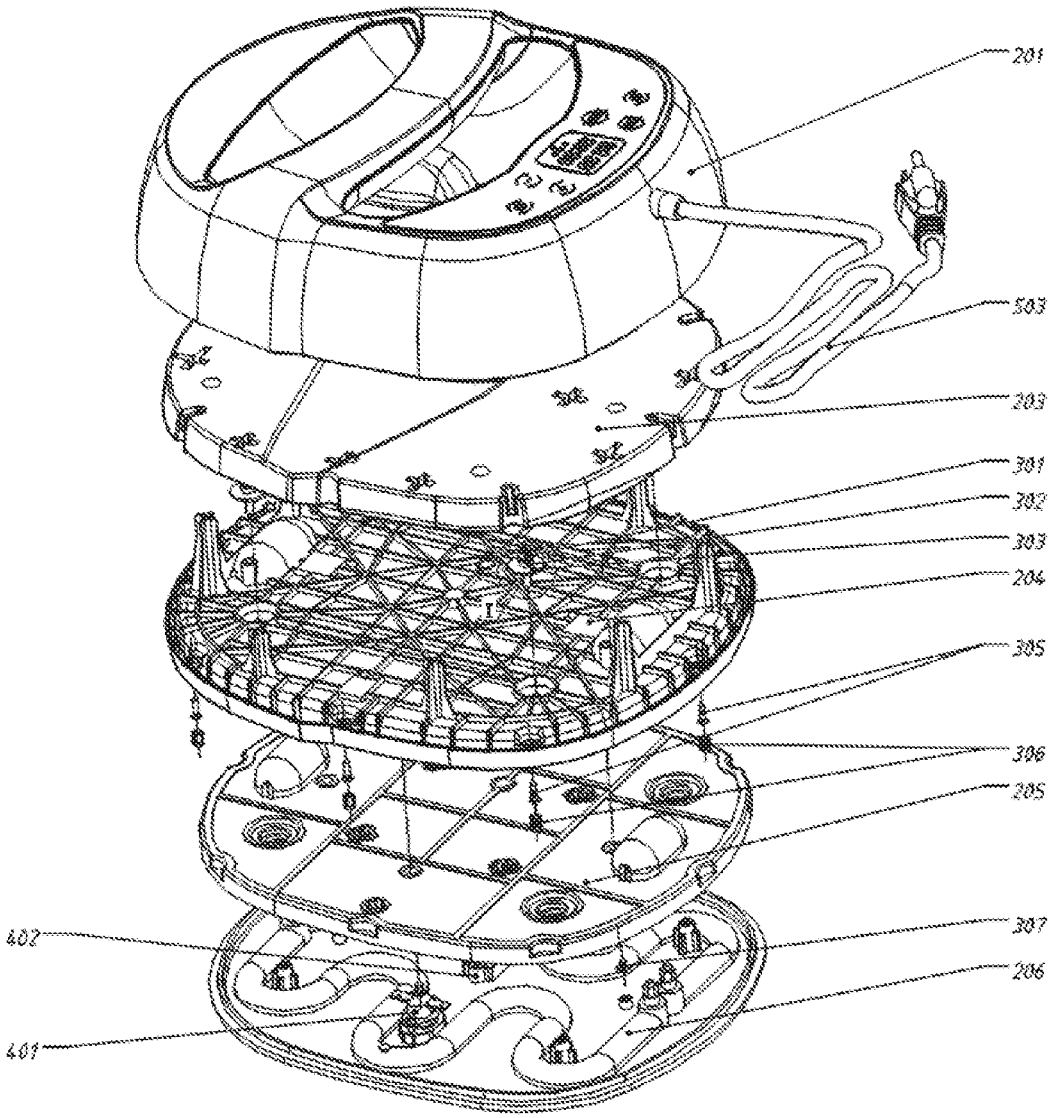
FIG. 5 is an exploded view of the host assembly.
Figure 6:
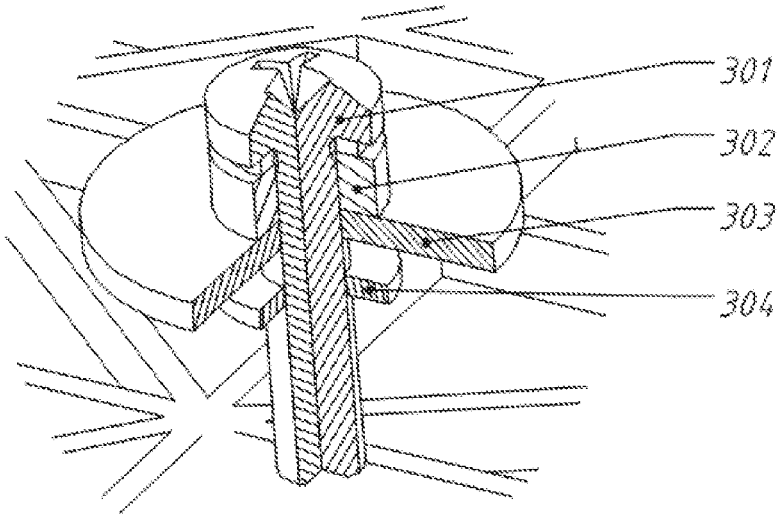
FIG. 6 is an enlarged view of the inner cross round head screw of FIG. 5.
Figure 7:
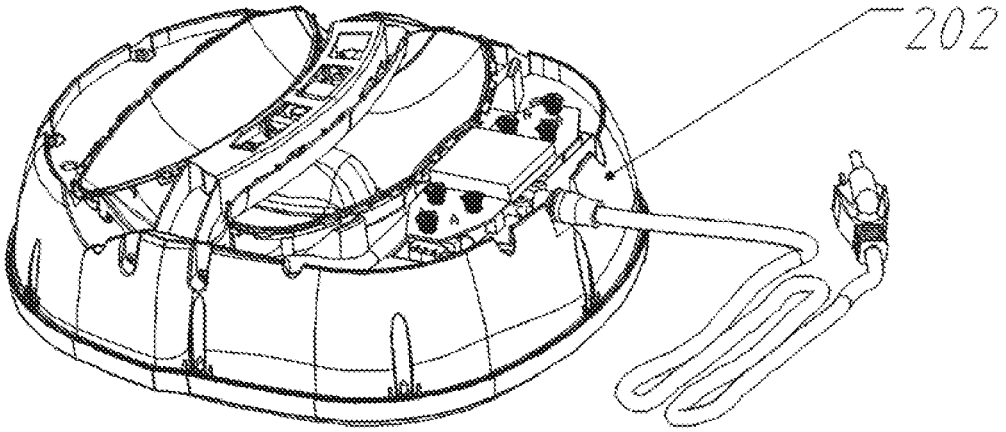
FIG. 7 is a structural view of the host assembly after removing the outer shell.

Specifically, referring to FIG. 4, the primary insulation shell 205 is an asbestos high-temperature insulation layer, which prevents the heat from transferring from the heating plate 206 to the fixing shell 204; the secondary insulation shell 203 is also an asbestos high-temperature insulation layer, which prevents heat from transferring from the fixing shell 204 to the outer shell 201; the fixing shell 204 is made of PA66+15% GF injection molding and has a certain strength for fixing the heating plate 206 readily.

Referring to FIG. 4 and FIG. 8, the heating plate 206 is a flat structure of die-casting aluminum with intermediately buried heating tubes 207, the heating tubes 207 being distributed in a serpentine shape and connected in series to make the heating surface more uniform.

Referring to FIG. 3-11, the specific connection relationship of each component is as follows:

A bottom edge of the outer shell 201 and an edge of the fixing casing 204 are provided with a first type of fixing holes correspondingly and are connected by the inner cross countersunk head self-tapping screw 305; a hole plug 306 made of high temperature resistant silicone is provided outside the inner cross countersunk head self-tapping screw 305;

A top edge of the inner shell 202 is fixed with a top plate by an inner cross round head cut tail self-tapping screw 308;

A bottom of the handle tray 2021 is fixed with a first type of connecting column and is connected with a top plate of the inner shell 202 by the inner cross round head cut tail self-tapping screw 308; a handle beam 2022 is provided at the top of the handle tray 2021, the radiator 2023 is arranged in the handle beam 2022, and two sides of the radiator 2023 are connected with an edge of the inner shell 202 by an inner cross round head screw 301;

The heating plate 206 is fixed with a second type of connecting column, the primary thermal insulation shell 205 is correspondingly provided with a perforation, the fixing shell 204 is correspondingly provided with a second type of fixing holes, and the second type of fixing holes are internally screwed with the inner cross round head screw 301, a first thermal insulation gasket 302 and a second thermal insulation gasket 303 are provided between a top of the inner cross round head screw 301 and the fixing shell 204, a bottom end of the inner cross round head screw 301 passes through the perforation and is screwed to the second type connecting column, a third thermal insulation gasket 304 is provided between the lower section of the inner cross round head screw 301 and the fixing shell 204.

It should be noted that the inner cross round head screw 301 here is used to connect the heating plate 206 and the fixing shell 204. Since the lower end of the screw is screwed into the heating plate 206, there is a large amount of heat conduction, and the screw is hot. In order to avoid heat conduction, the above-mentioned thermal insulation gasket is used to prevent heat from transferring to the fixing shell of the heating plate. At the same time, the inner diameter of the perforation of the primary thermal insulation shell 205 is larger than the diameter of the screw to prevent heat conduction from the screw. In this way, heat conduction from the heating plate is prevented as much as possible to prevent the outer shell from overheating.

The fixing shell 204 is fixed with a cross engaging column, and the secondary thermal insulation plate is correspondingly provided with a cross hole which matches with the cross engaging column to achieve the location of fixing shell 204 and secondary thermal insulation plate;

The high-frequency energy conversion motor 406 is stuck between the handle tray 2021 and the inner shell 202, an inner cross countersunk head cutting tail self-tapping screw 309 is provided on both sides, and the inner cross countersunk head cutting tail self-tapping screw 309 is screwed on a bottom of the handle tray 2021 and fixes the high-frequency transducer motor 406 at a limited position;

The central control board 404 is fixed on an inner side of the outer shell 201 by an inner cross round head padded self-tapping screw 307; the high-frequency switching power supply 405 is fixed on the inner shell 202 by the inner cross round head padded self-tapping screw 307; the inner shell 202 and the outer shell 201 are provided with corresponding wire outlets at rear ends; an inner side of the inner shell 202 that corresponds to the wire outlet is provided with a wire clamp 501, and the power line 503 extends out from the wire outlet after being clamped by the wire clamp 501 and is provided with a wire protection tube 502;

The snap-action temperature controller 401 and the temperature sensor 402 are fixed on the heating plate 206 by the inner cross round head screw 301.

The above connection relationship details the setting and installation structure of the host assembly 200. In actual use, the outer shell 201 has less heat conduction and low temperature, which will not affect the user.

In actual use, this device can be designed into different sizes according to requirement. The larger the size is, the larger the applicable product area is, and the higher the frequency of the high-frequency energy conversion motor is.

The present disclosure also discloses a pressureless high-frequency suspension thermal transfer printing method, in which a high-frequency signal of 60-100 Hz is generated by a high-frequency switching power supply 405, and a high-frequency energy conversion motor 406 is driven to convert a signal into high-frequency mechanical vibration which produces 60-100 Hz high-frequency waves which propagate in a longitudinally diffused manner in which an entire transfer printing surface is covered in a direction that is perpendicular to the transfer printing surface, avoiding wasteful loss in the direction of a lateral propagation that is parallel to the transfer printing surface, so that the high-frequency waves act on a molecular movement during the transfer printing process to the greatest extent, which effectively changes a state of the molecular movement, enhances a molecular penetration force, realizes replacement of physical pressure with the high-frequency waves, completely changes a thermal transfer printing process, and achieves pressureless thermal transfer printing.

Embodiment 2

On the basis of Embodiment 1, the host assembly 200 is further provided with a placing plate 100, and the host assembly 200 is disposed inside the placing plate 100 which is convenient for pick and place.

Referring to FIGS. 12-16, the placing plate 100 has a ring shape, which is composed of identical four-segment quarter-arc-shaped pieces 101 which are clipped with each other by head and tail; feet 102 are provided at bottom part of the placing plate 100; the placing plate 100 is provided with a limiting block 103 on an outer ring and a suspension 104 on an inner ring.

The placing plate adopts the same arc-shaped block structure. Only a pair of smaller molds is needed during production, the overall production difficulty and cost are greatly reduced, and the packaging volume is greatly reduced when the product is packaged. Especially in international trade where higher requirements on transportation costs exist, the present placing plate plays a role in reducing costs and improving product competitiveness. In addition, the device can be oriented randomly when used because of the ring shape thereof. It does not require time to align, which is more convenient to use.

It should be noted that the above-mentioned electrical components are all commercially available components, and the control circuit can be implemented by simple programming by those skilled in the art. In order to avoid redundant descriptions, they are collectively described here.

In the description of this specification, the description with reference to the terms "one embodiment", "example", "specific example", etc. means that specific features, structures, materials described in combination with the embodiment or example are comprised in at least one embodiment or example of the present disclosure. In this specification, the schematic expressions of the above terms do not necessarily refer to the same embodiment or example. Furthermore, the particular features, structures, materials, or characteristics described may be combined in any suitable manner in any one or more embodiments or examples.

The preferred embodiments of the present disclosure disclosed above are only used to help explain the present disclosure. The preferred embodiment does not describe all details in detail, nor does it limit the present disclosure to specific embodiments. Obviously, many modifications and changes can be made according to the contents of this specification. These embodiments are selected and described in this specification in order to better explain the principles and practical applications of the present disclosure, so that those skilled in the art can better understand and use the present disclosure. The present disclosure is limited only by the claims and the full scope and equivalents thereof.

What is claimed:

1. A pressureless high-frequency suspension thermal transfer printer, comprising:

a host assembly (200), characterized in that the host assembly (200) is provided from top to bottom with an outer shell (201), an inner shell (202), a secondary thermal insulation shell (203), a fixing shell (204), a primary thermal insulation shell (205) and a heating plate (206);

a handle tray (2021) is provided between the outer shell (201) and the inner shell (202), a high-frequency energy conversion motor (406) is provided between the handle tray (2021) and the inner shell (202);

a handle beam (2022) is provided on a top of the handle tray (2021), a radiator (2023) is provided in the handle beam (2022), and a control output board (403) is installed in the radiator (2023), the heating plate (206) is also provided with a snap-action temperature controller (401) and a temperature sensor (402);

a central control board (404) is provided on a rear top of the outer shell (201), a high-frequency switching power supply (405) is provided below the central control board (404), and the high-frequency switching power supply (405) is connected to an external power line (503) which is provided with a plug at an outer end; and a control panel (2024) is provided on a rear top surface of the outer shell (201).

2. The pressureless high-frequency suspension thermal transfer printer according to claim 1, characterized in that the high-frequency switching power supply (405) is electrically connected to the control output board (403) through a high-frequency current input line, the control output board (403) is electrically connected to the central control board (404) through a signal transmission line, the control output board (403) is electrically connected to the high-frequency energy conversion motor (406) through a high-frequency current output line, the temperature sensor (402) is electrically connected to the central control board (404) through a temperature signal transmission line, and the power line (503) receives a 220V AC power and is divided into two circuits, one of which is directly connected to the high-frequency switching power supply (405) and converts the 220V AC power into 60-100 Hz oscillating current that flows into the control output board (403), and the other of which is connected to the control output board (403), to the snap-action temperature controller (401) and then to the heating plate (206).

3. The pressureless high-frequency suspension thermal transfer printer according to claim 2, characterized in that the central control board (404) controls connection and disconnection to the 220V AC power, the temperature sensor (402) is connected to the central control board (404) to collect temperature data of the heating plate (206) to provide basic data for temperature control, the control output board (403) is connected to the central control board (404) and receives various instructions from the central control board (404) to control start and stop of the high-frequency energy conversion motor (406) and start and stop of the heating plate (206), the snap-action temperature controller (401) causes a power to cut off when the heating plate (206) reaches a temperature limit, and buttons on the central control board (404) correspond to buttons on the control panel (2024).

4. The pressureless high-frequency suspension thermal transfer printer according to claim 1, characterized in that the primary thermal insulation shell (205) is an asbestos high-temperature resistant thermal insulation layer and prevents heat from transferring from the heating plate (206) to the fixing shell (204), the secondary thermal insulation shell (203) is also an asbestos high-temperature resistant thermal insulation layer and prevents heat from transferring from the fixing shell (204) to the outer shell (201); the fixing shell (204) is made of PA66+15% GF by injection molding.

5. The pressureless high-frequency suspension thermal transfer printer according to claim 1, characterized in that the heating plate (206) is a flat structure of die-casting aluminum with intermediately buried heating tubes (207), and the heating tubes (207) are distributed in a serpentine shape and a plurality of which are connected in series.

6. The pressureless high-frequency suspension thermal transfer printer according to claim 1, characterized in that a bottom edge of the outer shell (201) and a corresponding edge of the fixing casing (204) are provided with a first type of fixing holes and are connected by the inner cross countersunk head self-tapping screw (305);

a hole plug (306) made of high temperature resistant silicone is provided outside the inner cross countersunk head self-tapping screw (305);

a top edge of the inner shell (202) is fixed with a top plate by an inner cross round head cut tail self-tapping screw (308);

a bottom of the handle tray (2021) is provided with a first type of connecting column and is connected with a top plate of the inner shell (202) by the inner cross round head cut tail self-tapping screw (308);

a top of the handle tray (2021) is provided with a handle beam (2022), the radiator (2023) is arranged in the handle beam (2022), and two sides of the radiator (2023) are connected with an edge of the inner shell (202) by an inner cross round head screw (301);

the heating plate (206) is provided with a second type of connecting column, the primary thermal insulation shell (205) is correspondingly provided with a perforation, the fixing shell (204) is correspondingly provided with a second type of fixing holes, and the second type of fixing holes are internally screwed with the inner cross round head screw (301), a first thermal insulation gasket (302) and a second thermal insulation gasket (303) are provided between a top of the inner cross round head screw (301) and the fixing shell (204), a bottom end of the inner cross round head screw (301) passes through the perforation and is screwed to the second type connecting column, a third thermal insulation gasket (304) is provided between the lower section of the inner cross round head screw (301) and the fixing shell (204); and an inner diameter of the perforation of the primary thermal insulation shell (205) is larger than a diameter of the inner cross round head screw (301);

the fixing shell (204) is provided with a cross engaging column, and the secondary thermal insulation plate is correspondingly provided with a cross hole which matches with the cross engaging column.

7. The pressureless high-frequency suspension thermal transfer printer according to claim 1, characterized in that:

the high-frequency energy conversion motor (406) is stuck between the handle tray (2021) and the inner shell (202), an inner cross countersunk head cutting tail self-tapping screw (309) is provided on both sides, and the inner cross countersunk head cutting tail self-tapping screw (309) is screwed on a bottom of the handle tray (2021) and fixes the high-frequency transducer motor (406) at a limited position;

the central control board (404) is fixed on an inner side of the outer shell (201) by an inner cross round head padded self-tapping screw (307);

the high-frequency switching power supply (405) is fixed on the inner shell (202) by the inner cross round head padded self-tapping screw (307);

the inner shell (202) and the outer shell (201) are provided with corresponding wire outlets at rear ends;

an inner side of the inner shell (202) that corresponds to the wire outlet is provided with a wire clamp (501), and the power line (503) extends out from the wire outlet after being clamped by the wire clamp (501) and is provided with a wire protection tube (502);

the snap-action temperature controller (401) and the temperature sensor (402) are fixed on the heating plate (206) by the inner cross round head screw (301).

8. The pressureless high-frequency suspension thermal transfer printer according to claim 1, further comprising a placing plate (100) within which the host assembly (200) is cooperatively arranged;

the placing plate (100) has a ring shape, which is composed of identical four-segment quarter-arc-shaped pieces (101) which are clipped with each other by head and tail; feet (102) are provided at bottom part of the placing plate (100);

the placing plate (100) is provided with a limiting block (103) on outer ring and a suspension (104) on inner ring.

* * * * *